US010351405B2

(12) United States Patent
Jalbert et al.

(10) Patent No.: US 10,351,405 B2
(45) Date of Patent: Jul. 16, 2019

(54) CAPPING MACHINE

(71) Applicant: JALBERT AUTOMATISATION INC., Boisbriand (CA)

(72) Inventors: Luc Jalbert, Boisbriand (CA); Steve Boissonneault, St-Hippolyte (CA); Alexandre Lebel, Laval (CA); Maxime Demers, Laval (CA); Alexandru Berceanu, St-Eustache (CA); Jonathan Monette, Ste-Therese (CA)

(73) Assignee: NJM PACKAGING INC., Quebec (CA)

( * ) Notice: Subject to any disclaimer, the term of this patent is extended or adjusted under 35 U.S.C. 154(b) by 593 days.

(21) Appl. No.: 15/041,682

(22) Filed: Feb. 11, 2016

(65) Prior Publication Data

US 2017/0233233 A1 Aug. 17, 2017

(51) Int. Cl.
*B67B 3/20* (2006.01)
*B67B 3/26* (2006.01)

(52) U.S. Cl.
CPC ..... *B67B 3/2053* (2013.01); *B67B 3/2066* (2013.01); *B67B 3/264* (2013.01)

(58) Field of Classification Search
CPC ..... B67B 3/2053; B67B 3/2066; B67B 3/264
USPC ..... 53/490
See application file for complete search history.

(56) References Cited

U.S. PATENT DOCUMENTS 1,664,514 A * 4/1928 Kramer ..... B67B 3/2046 53/314
2,855,736 A * 10/1958 Harmon ..... B67B 3/2046 53/313
2,876,605 A * 3/1959 McElroy ..... B67B 3/2046 53/315
2,917,880 A * 12/1959 Hohl ..... B65B 31/00 53/314
2,942,394 A * 6/1960 Bjering ..... B67B 3/2046 53/314
3,280,534 A * 10/1966 Hildebrandt ..... B67B 3/2046 53/315
3,380,225 A * 4/1968 Ochs ..... B65B 7/2807 53/110
3,438,174 A * 4/1969 Foss ..... B65B 7/2807 53/110
3,845,605 A * 11/1974 Hartness ..... B65B 43/40 53/381.4

(Continued)

FOREIGN PATENT DOCUMENTS

DE 4132695 A1 4/1993

*Primary Examiner* — Alexander M Valvis
*Assistant Examiner* — Lucas E. A. Palmer
(74) *Attorney, Agent, or Firm* — Thompson Hine LLP

(57) ABSTRACT

A capping machine for screwing a threaded cap on a threaded container having a threaded finish, the capping machine receiving the threaded cap from a cap distributor. The capping machine includes a cap guiding element provided above cap screwing belts, both being provided above a conveyor. The cap guiding element is movable between an upper position and a lower position. The cap guiding element is configured for abutting downwardly against the threaded cap when the threaded cap is in register therewith and maintaining the threaded cap in a predetermined attitude for at least part of the screwing process. The cap guiding element moves towards the lower position as the cap screwing belts screw the threaded cap on the threaded container.

18 Claims, 9 Drawing Sheets

(56) References Cited

U.S. PATENT DOCUMENTS 3,905,177 A * 9/1975 Herzog ..... B67B 3/064 198/379
3,977,161 A * 8/1976 Faber ..... B65B 7/2807 53/313
3,986,323 A * 10/1976 Aidlin ..... B65B 7/2807 53/314
4,199,914 A * 4/1980 Ochs ..... B67B 3/2046 53/314
4,569,181 A * 2/1986 Raudat ..... B65B 39/006 198/570
4,608,806 A * 9/1986 Haslam ..... B67B 3/2046 53/314
5,007,228 A * 4/1991 Herzog ..... B67C 7/0026 198/620
5,398,480 A * 3/1995 Bankuty ..... B67B 3/06 53/315
5,423,159 A * 6/1995 Bankuty ..... B65B 7/2835 53/253
5,669,209 A * 9/1997 Dewees ..... B65B 7/2835 53/314
5,858,141 A * 1/1999 Repp ..... B29C 65/3656 156/69
5,918,442 A 7/1999 Dewees et al.
6,023,910 A * 2/2000 Lubus ..... B67B 3/2046 53/317
6,430,896 B1 * 8/2002 Torikian ..... B65B 7/2835 53/310
6,732,487 B2 * 5/2004 Bouraoui ..... B65B 7/2835 53/317
7,325,369 B2 2/2008 Jalbert
8,615,972 B2 * 12/2013 Bassani ..... B67B 3/261 53/331.5
2007/0006550 A1 * 1/2007 Kemper ..... A61L 2/22 53/426
2007/0095018 A1 * 5/2007 Perazzo ..... B67B 3/2046 53/317
2007/0193226 A1 * 8/2007 Jalbert ..... B65B 7/2835 53/331.5
2012/0110950 A1 * 5/2012 Schraudolph ..... B65B 7/2835 53/331.5
2012/0167526 A1 * 7/2012 Shi ..... B67B 3/20 53/287
2012/0311963 A1 * 12/2012 Fukuda ..... B67B 3/2053 53/317
2015/0166317 A1 * 6/2015 Uriel ..... B67B 3/2053 53/490

* cited by examiner

CAPPING MACHINE

FIELD OF THE INVENTION

The present invention relates to the general field of container handling, and is more particularly concerned with a capping machine.

BACKGROUND

Automatic capping of containers is common in many industries. One type of capping machine used to perform the capping process screws a threaded cap on a threaded container having a threaded finish. To that effect, the capping machine may advance the containers with a conveyor. At some point along the conveyor, a cap is positioned above the container and the cap and conveyor assembly subsequently moves to a capping head. For example, the capping head includes a pair of belts moving at different speeds between which the cap moves. The belts move one side of the cap faster than the other side, due to their speed differential, which screws the cap as the container advances along the conveyor.

A common problem in such automatic capping is cross-threading. This problem occurs when the cap tilts when the threads of the finish are engaged by the threads of the cap. As a result, the cap is cocked and the container is not hermetically sealed by the cap. To prevent distribution of such problematic containers, there is a need to inspect all containers coming out of the capping machine and to reject cross-threaded containers, which are either disposed or otherwise handled. These operations require either the use of relatively expensive machines and inspection systems, or of additional employees.

Accordingly, there exists a need for an improved capping machine. It is a general objective of the present invention to provide such a capping machine.

SUMMARY OF THE INVENTION

In a broad aspect, the invention provides a capping machine for screwing a threaded cap on a threaded container having a threaded finish, the capping machine receiving the threaded cap from a cap distributor, the capping machine comprising: a conveyor for moving forwardly the threaded container in a longitudinal path along the capping machine; a cap receiving element provided above the conveyor for receiving the threaded cap from the cap distributor and presenting the threaded cap to the threaded container, the cap receiving element being configured and positioned so that the threaded container engages and entrains the threaded cap when the threaded container advances past the threaded cap; a pair of laterally opposed cap screwing belts provided forwardly relative to the cap receiving element, the cap screwing belts being closed loop belts rotatable at different speeds and defining a cap receiving gap therebetween, the cap receiving gap being configured and sized to allow the cap screwing belts to rotate the threaded cap when the threaded cap is in the cap receiving gap; a cap guiding element defining an upper cap guide provided at least in part above the cap screwing belts for abutting downwardly on the threaded cap as the threaded cap is moved, the cap guiding element being movable between an upper position and a lower position corresponding respectively to an unscrewed threaded cap and to an at least partially screwed threaded cap, the upper cap guide being configured for abutting downwardly against the threaded cap when the threaded cap is in register therewith; a cap guiding element actuator operatively coupled to the cap guiding element for moving the cap guiding element between the cap guiding element upper and lower positions; a sensor positioned and operative for indicating when the threaded cap has advanced in register with the cap guiding element and issuing a corresponding sensor signal; and a controller operatively coupled to the cap guiding element actuator to selectively activate the cap guiding element actuator to move the cap guiding element between the upper and lower positions, the controller being operatively coupled to the sensor for receiving the sensor signal with the cap guiding element in the upper position and consequently causing the cap guiding element to move towards the lower position as the cap screwing belts screw the threaded cap on the threaded container. The cap guiding element is configured and sized to constrain the threaded cap in a fixed attitude relative to the capping machine when the threaded cap is advanced along at least part of the cap guiding element.

The invention may also provide a capping machine wherein the controller is further operative for activating the cap guiding element actuator to move back the cap guiding element to the upper position once the threaded cap has advanced past the cap guiding element.

The invention may also provide a capping machine wherein the cap guiding element actuator moves the cap guiding element downwardly at a controlled predetermined rate when the threaded cap is screwed.

The invention may also provide a capping machine wherein the cap guiding element actuator is a pneumatic or electrical actuator.

The invention may also provide a capping machine wherein the cap guiding element actuator moves passively downwardly when the threaded cap is screwed.

The invention may also provide a capping machine further comprising a cap stabilizing element provided between the cap receiving element and the cap guiding element for stabilizing an attitude of the threaded cap before the threaded cap reaches the cap guiding element.

The invention may also provide a capping machine wherein the cap stabilizing element remains fixed relative to the cap receiving element while the threaded cap is advanced therealong.

The invention may also provide a capping machine wherein the cap stabilizing element defines a cap stabilizing element recess extending therealong for substantially fittingly receiving the threaded cap thereinto as the threaded cap is advanced therealong.

The invention may also provide a capping machine wherein the cap stabilizing element defines a cap stabilizing element upper wall, a pair of laterally opposed and spaced apart cap stabilizing element side walls extending downwardly from the cap stabilizing element upper wall, and a pair of cap stabilizing element flanges protruding laterally inwardly each from a respective one of the cap stabilizing element side walls opposed to the cap stabilizing element upper wall.

The invention may also provide a capping machine wherein the cap guiding element defines a cap guiding element recess extending along part thereof for substantially fittingly receiving the threaded cap thereinto as the threaded cap is advanced therealong.

The invention may also provide a capping machine wherein the cap guiding element recess extends from the back of the cap guiding element.

The invention may also provide a capping machine wherein the cap guiding element defines a cap guiding element upper wall, a pair of laterally opposed and spaced apart cap guiding element side walls extending downwardly from the cap guiding element upper wall and extending longitudinally along part thereof, and a pair of cap guiding element flanges protruding laterally inwardly each from a respective one of the cap guiding element side walls opposed to the cap guiding element upper wall.

The invention may also provide a capping machine wherein the cap guiding element flanges each define a forward protruding portion protruding forwardly from the cap guiding element side walls.

The invention may also provide a capping machine wherein the cap screwing belts have part thereof in register with the forward protruding portions.

The invention may also provide a capping machine further comprising a chute for receiving a plurality of said caps serially and delivering said caps to said cap receiving element.

The invention may also provide a capping machine wherein the conveyor includes a bottom belt for resting the threaded containers thereonto and a pair of side belts between the bottom belt and the cap screwing belts for gripping the threaded container therebetween.

The invention may also provide a capping machine wherein the conveyor advances the threaded container at a substantially constant speed therealong.

The invention may also provide a capping machine wherein the cap receiving gap defines substantially longitudinally opposed gap rear and front sections and a gap middle section extending therebetween, the gap rear section tapering in a direction leading towards the gap middle section.

The invention may also provide a capping machine wherein the gap middle section is of substantially constant width therealong.

In another broad aspect, the invention provides a method for capping a threaded container with a threaded cap, the method comprising: advancing the threaded container forwardly along a predetermined path; presenting the threaded cap to the threaded container at a cap pickup location along the predetermined path; engaging the threaded cap with the threaded container at the pickup location and subsequently entraining the threaded cap with the threaded container; fixing the attitude of the threaded cap to a predetermined attitude forwardly of the pickup location; screwing the threaded cap on the threaded container using a pair of opposed belts while the threaded container and threaded cap advance along the predetermined path; and forcing the threaded cap to maintain the predetermined attitude until the threaded cap is at least partially screwed on the threaded container.

In yet another broad aspect, the invention provides a capping machine for screwing a threaded cap on a threaded container having a threaded finish, the capping machine receiving the threaded cap from a cap distributor, the capping machine comprising: a conveyor for moving forwardly the threaded container in a longitudinal path along the capping machine; a cap receiving element provided in register with and spaced apart from the conveyor for receiving the threaded cap from the cap distributor and presenting the threaded cap to the threaded container, the cap receiving element being configured and positioned so that the threaded container engages and entrains the threaded cap when the threaded container advances past the threaded cap; a pair of laterally opposed cap screwing belts provided forwardly relative to the cap receiving element, the cap screwing belts being closed loop belts rotatable at different speeds and defining a cap receiving gap therebetween, the cap receiving gap being configured and sized to allow the cap screwing belts to rotate the threaded cap when the threaded cap is in the cap receiving gap; a cap guiding element defining an upper cap guide, the cap screwing belts being provided between the upper cap guide and the conveyor, the cap guiding element being movable between a first position and a second position corresponding respectively to an unscrewed threaded cap and to an at least partially screwed threaded cap, the upper cap guide being configured for abutting against the threaded cap towards the conveyor when the threaded cap is in register therewith; a cap guiding element actuator operatively coupled to the cap guiding element for moving the cap guiding element between the cap guiding element first and second positions; a sensor positioned and operative for indicating when the threaded cap has advanced in register with the cap guiding element and issuing a corresponding sensor signal; and a controller operatively coupled to the cap guiding element actuator to selectively activate the cap guiding element actuator to move the cap guiding element between the first and second positions, the controller being operatively coupled to the sensor for receiving the sensor signal with the cap guiding element in the upper position and consequently causing the cap guiding element to move towards the lower position as the cap screwing belts screw the threaded cap on the threaded container. The cap guiding element is configured and sized to constrain the threaded cap in a fixed attitude relative to the capping machine when the threaded cap is advanced along at least part of the cap guiding element.

Advantageously, the proposed capping machine reduces or nearly eliminates the possibility of cross-threading. This is achieved using a relatively inexpensive modification of existing capping machines.

Other objects, advantages and features of the present invention will become more apparent upon reading of the following non-restrictive description of preferred embodiments thereof, given by way of example only with reference to the accompanying drawings.

DETAILED DESCRIPTION

The term "substantially" is used throughout this document to indicate variations in the thus qualified terms. These variations are variations that do not materially affect the manner in which the invention works and can be due, for example, to uncertainty in manufacturing processes or to small deviations from a nominal value or ideal shape that do not cause significant changes to the invention. These variations are to be interpreted from the point of view of the person skilled in the art.

Figure 1:
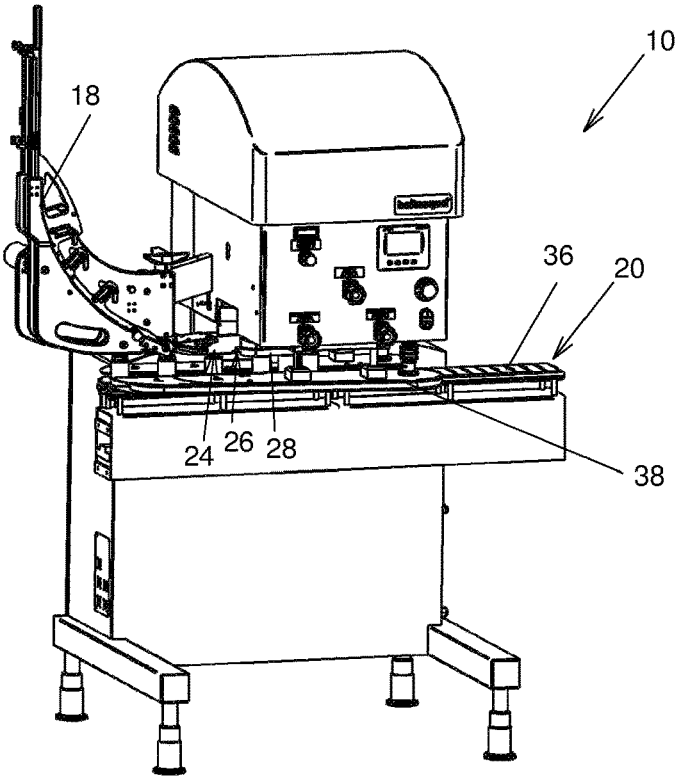
FIG. 1, in a perspective view, illustrates a capping machine in accordance with an embodiment of the present invention.
Figure 3:
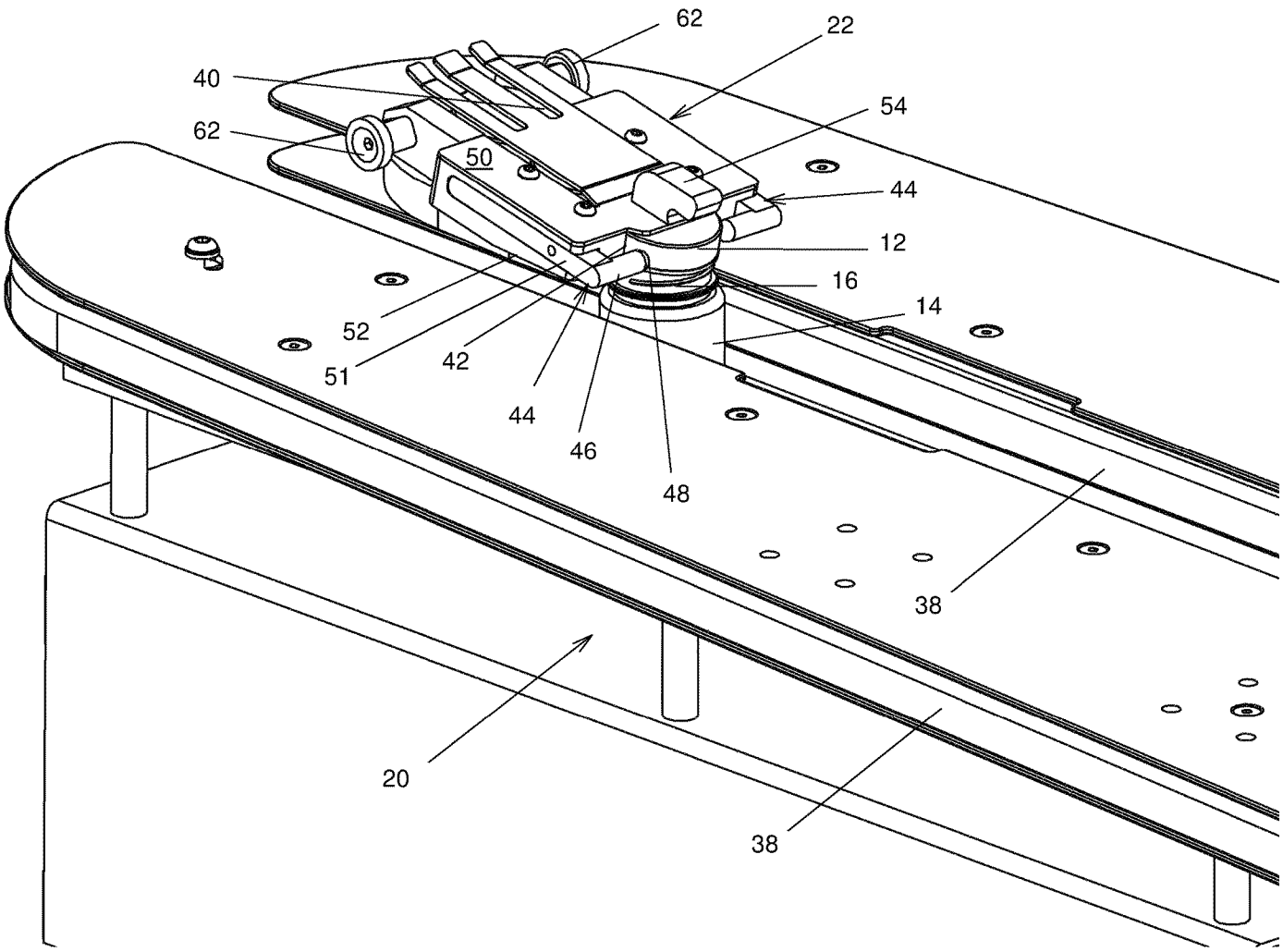
FIG. 3, in a perspective view with parts removed, illustrates a first step in the operation of the capping machine of FIG. 1.
Figure 9:
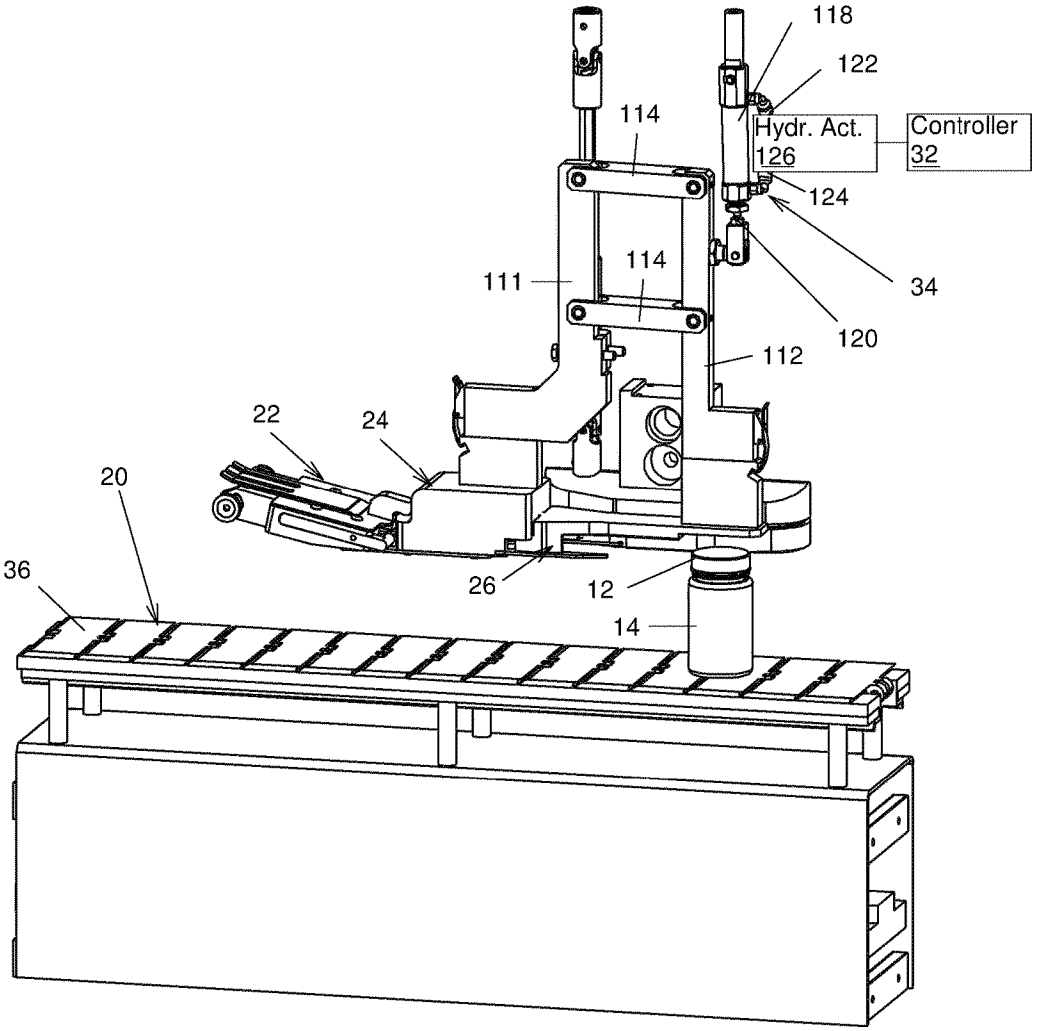
FIG. 9, in a perspective view with parts removed, illustrates a cap guiding element actuator part of the capping machine of FIG. 1 and its relationship with other parts of the capping machine.
Figure 10:
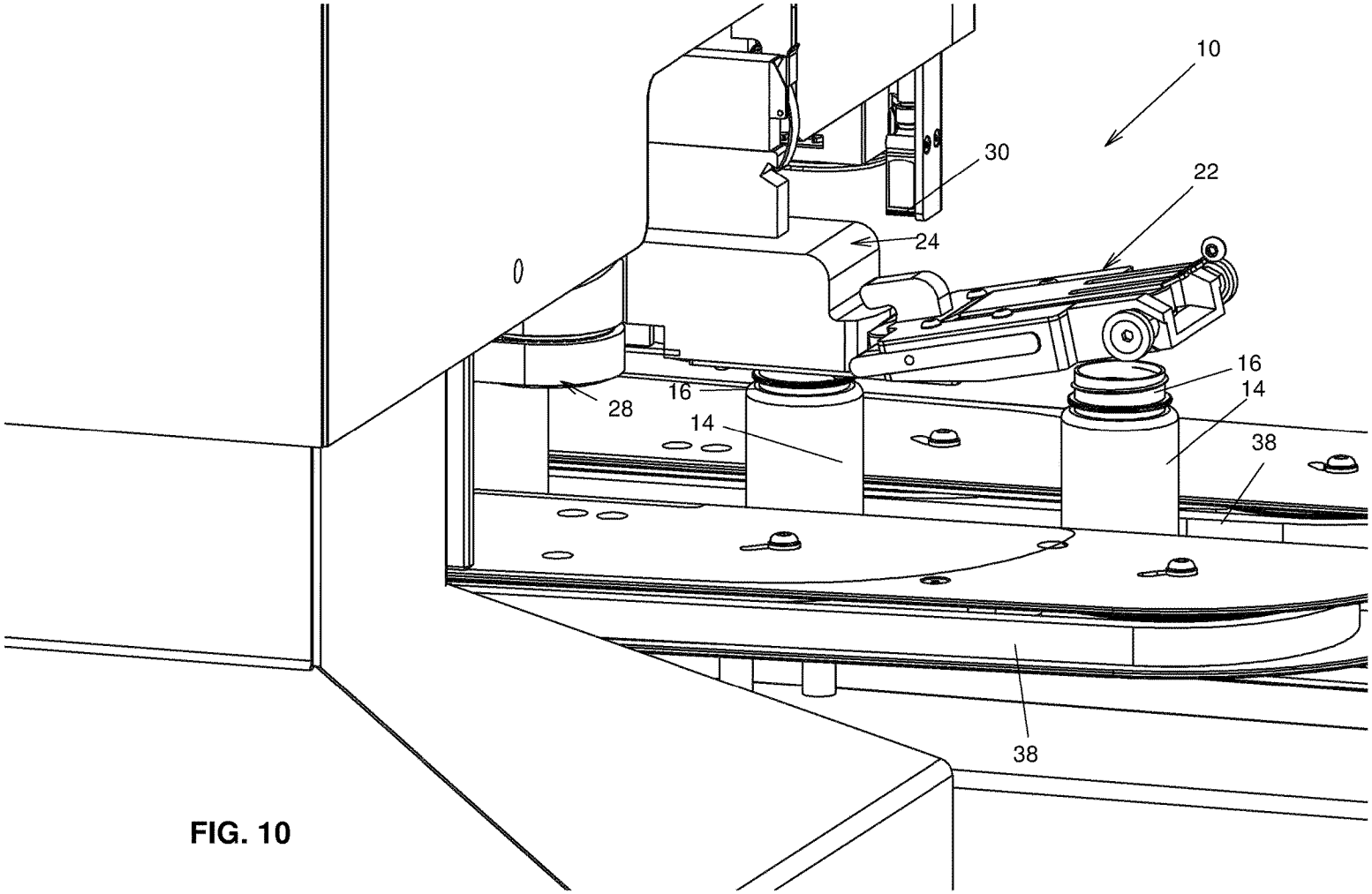
FIG. 10, in a partial perspective view, illustrates a sensor part of the capping machine of FIG. 1 and its relationship with other parts of the capping machine.

With reference to FIG. 1, the invention relates to a capping machine 10 for screwing a threaded cap 12 on a threaded container 14 (both better seen for example in FIG. 3). The threaded container 14 has a threaded finish 16 on which the threaded cap is to be screwed. The capping machine 10 receives the threaded cap 12 from a cap distributor 18 and the threaded containers 14 from a container distributor (not shown in the drawings). The cap distributor 18, seen in FIG. 1, takes for example the form of a chute for serially providing threaded caps 12. The container distributor is conventional and may for example take the form of the outlet of a filling station wherein the threaded containers 14 are filled. The capping machine 10 includes a conveyor 20. Also, as seen for example in FIG. 7, the capping machine 10 includes a cap receiving element 22, a cap stabilizing element 24, which may be omitted in some embodiments, a cap guiding element 26 and cap screwing belts 28. Referring to FIG. 9, a controller 32 controls a cap guiding element actuator 34 which moves the cap guiding element 26 between upper and lower positions. A sensor 30, seen in FIG. 10, is connected to the controller 32 for synchronizing the movements of the cap guiding element 26 with the position of the threaded container 14 along the capping machine 10.

The present document uses directional terminology such as upper, lower, above and below to refer to the capping machine 10 in a typical configuration in which the threaded containers 14 are advanced standing upright and opening upwardly, with the threaded caps 12 provided thereabove. This terminology is used to facilitate description of the capping machine 10 and should not be used to restrict the scope of the claims. Indeed, in some embodiments, the capping machine 10 may be used in different orientations if the contents of the threaded containers 14 allows so, or if the threaded containers 14 are empty.

The conveyor 20 moves forwardly the threaded container 14 in a longitudinal path along the capping machine 10. For reference purposes, the position of the threaded container as the threaded container 14 enters the conveyor 20 is referred to as the container back position and the position of the threaded container as the threaded container 14 exits the conveyor 20 is referred to as the container front position. The conveyor 20 typically advances the threaded containers 14 at a constant speed along the capping machine 10, but stop and go operation or variable speed operation of the conveyor 20 is also within the scope of the present invention.

Referring to FIG. 3 for example, the cap receiving element 22 is provided above the conveyor 20 for receiving the threaded cap 12 from the cap distributor 18 (not shown in FIG. 3) and presenting the threaded cap 12 to the threaded container 14. The cap receiving element 22 is configured and positioned so that the threaded container 14 engages and entrains the threaded cap 12 when the threaded container 14 advances past the threaded cap 12.

Figure 7:
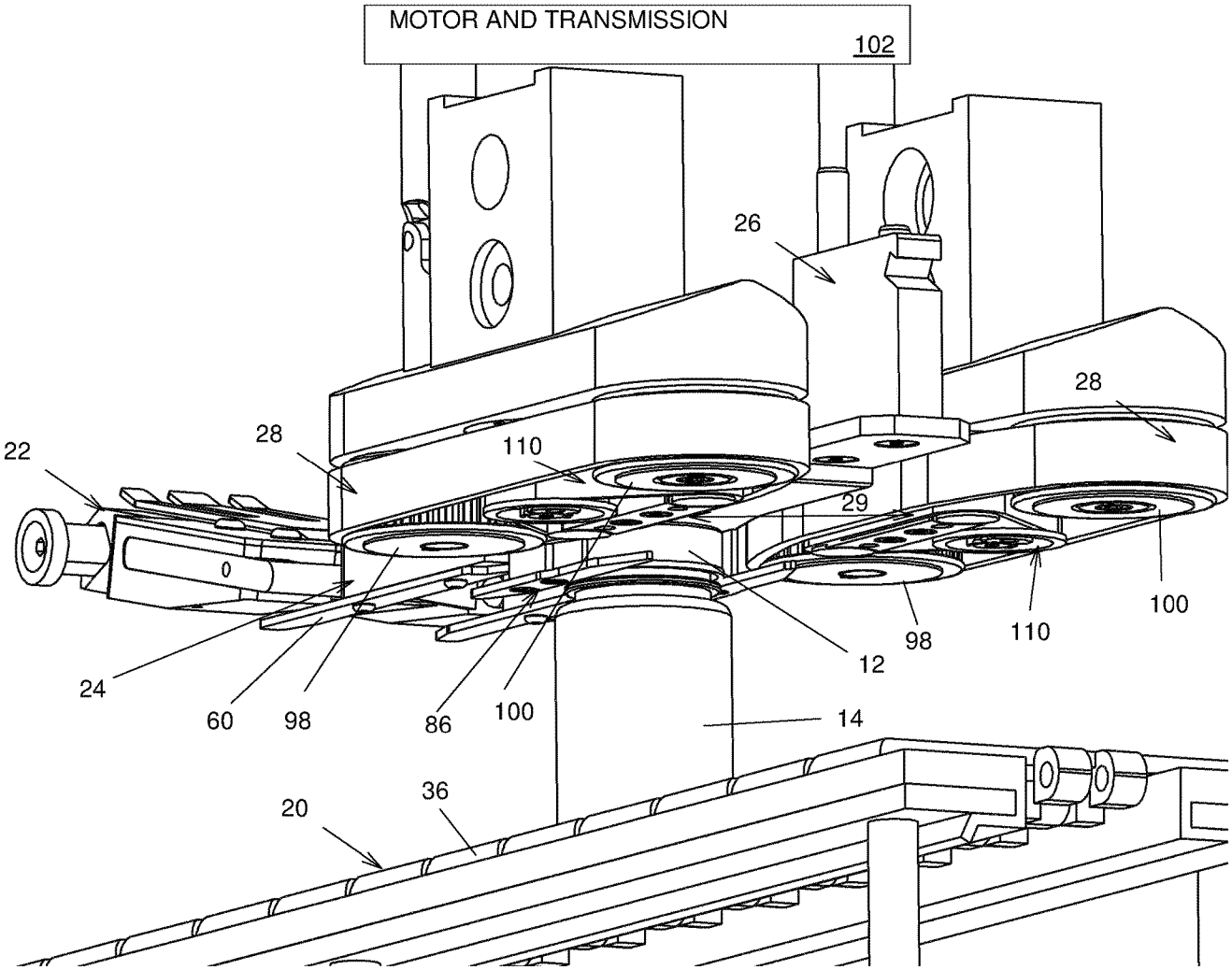
FIG. 7, in a perspective view with parts removed, illustrates a fifth step in the operation of the capping machine of FIG. 1.

A pair of laterally opposed cap screwing belts 28, seen for example in FIG. 7) are provided forwardly relative to the cap receiving element 22. The cap screwing belts 28 are closed loop belts rotatable at different speeds and defining a cap receiving gap 29 therebetween. The cap receiving gap 29 is configured and sized to allow the cap screwing belts 28 to rotate the threaded cap 12 when the threaded cap 12 is in the cap receiving gap 29.

The cap guiding element defines an upper cap guide, for example in the form of a cap guiding element upper wall 80 described hereinbelow. The upper cap guide is provided at least in part above the cap screwing belts 28 for abutting downwardly on the threaded cap 12 as the threaded cap 12 is moved. The cap guiding element 26 is movable between an upper position (seen for example in FIG. 4) and a lower position (seen for example in FIG. 7) corresponding respectively to an unscrewed threaded cap 12 and to an at least partially screwed threaded cap 12. The upper cap guide is configured for abutting downwardly against the threaded cap 12 when the threaded cap 12 is in register therewith. The cap guiding element 26 is configured and sized to constrain the threaded cap 12 in a fixed attitude relative to the capping machine 10 when the threaded cap 12 is advanced along at least part of the cap guiding element 26.

When present, the cap stabilizing element 24 is provided between the cap receiving element 22 and the cap guiding element 26 for stabilizing an attitude of the threaded cap 12 before the threaded cap 12 reaches the cap guiding element 26. In some embodiments, the cap stabilizing element 24 is omitted and the cap receiving element 22 and cap guiding element 26 are then substantially adjacent to each other. However, having the cap stabilizing element 24 is advantageous as it increases the number of threaded containers 14 that may be capped each hour.

The sensor 30 is positioned and operative for indicating when the threaded cap 12 has advanced in register with the cap guiding element 26 and issuing a corresponding sensor signal. The controller 32 is operatively coupled to the cap guiding element actuator 34 to selectively activate the cap guiding element actuator 34 to move the cap guiding element 26 between the upper and lower positions. The controller 32 is also operatively coupled to the sensor 30 for receiving the sensor signal with the cap guiding element 26 in the upper position and consequently causing the cap guiding element 26 to move towards the lower position as the cap screwing belts 28 screw the threaded cap 12 on the threaded container 14.

The conveyor 20 is any suitable device that may advance the threaded container 14 along the capping machine 10. A specific and non-limiting example of such a conveyor 20 includes a conveyor bottom belt 36 (seen partially for example in FIG. 4) and a pair of conveyor side belts 38 (seen partially in FIG. 3). The threaded container 14 rests on the conveyor bottom belt 36 and the conveyor side belts 38 are provided above the conveyor bottom belt 36 and grip the threaded container 14 therebetween. The conveyor bottom and side belts 36 and 38 each form a loop around pulleys or gears and are entrained by actuators, typically electric motors, in a conventional manner. In some embodiments, the relative position of the conveyor bottom and side belts 36 and 38 may be changed so that the capping machine 10 is usable with threaded containers 14 having different dimensions and configurations. The conveyor side belts 38 are positioned so that the threaded container 14 is relatively firmly gripped thereby so that there is substantially no slip between the conveyor side belts 38 and threaded container 14 as the threaded cap 12 is screwed. The conveyor bottom and side belts 36 and 38 move at substantially the same velocity, with the surfaces thereof that contact the threaded containers moving forwardly.

Figure 2:
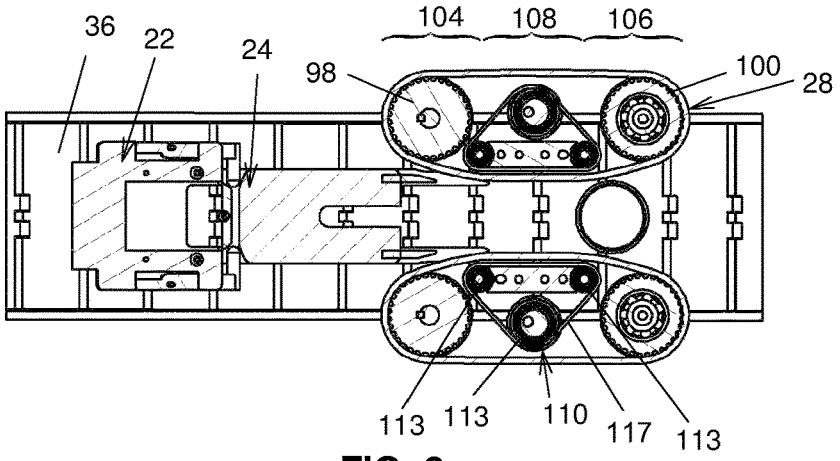
FIG. 2, in a top cross-sectional view with parts removed, illustrates the capping machine of FIG. 1.

The cap screwing belts 28 are typically substantially parallel to the conveyor side belts 38. The lateral distance between the cap screwing belts 28 may be smaller than, equal to, or larger than the lateral distance between the conveyor side belts 38, depending on the diameter of the threaded cap 12 relative to the diameter of the threaded container 14. As seen in FIG. 2, the cap screwing belts 28 are also looped around gears (not shown in the drawings) or pulleys 98 and 100, and rotated by actuators, such as a combined electrical motor and transmission assembly 102 to which one of the pulleys 98 are coupled, as schematically illustrated in FIG. 7.

The cap screwing belts 28 are positioned so that the threaded cap 12 is relatively firmly gripped thereby so that there is substantially no slip between the cap screwing belts 28 and threaded cap 12 as the threaded cap 12 is screwed. The spacing between the cap screwing belts 28 is typically adjustable in a conventional manner to allow use of the capping machine 10 with threaded caps 12 of different dimensions. The cap screwing belts 28 typically extend along a length sufficient to ensure that the threaded cap 12 is fully screwed on the threaded container 14 after the threaded container 14 has been advanced past the cap screwing belts 28. In some embodiments, the length of the cap screwing belts could be adjustable, along with the distance between the pulleys 98 and 100. The speed at which the cap screwing belts 28 are moved can be fixed or adjustable.

The cap screwing belts 28 extend along only part of the conveyor 20 and do not move at the same speed relative to each other. Indeed, there is a speed differential between the cap screwing belts 28 so that the threaded cap 12 may be screwed on the threaded container 14. This speed differential causes one side of the threaded cap 12 to move slower than the other side, which causes a rotation of the threaded cap 12. The average of the linear speeds of the cap screwing belts 28 at the points of contact with the threaded cap 12 is however equal to the linear speed of the threaded container 14 to maintain the attitude of the threaded container 14 during the screwing process.

In some embodiments, as seen for example in FIG. 2, the cap receiving gap 29 defines substantially longitudinally opposed gap rear and front sections 104 and 106 and a gap middle section 108 extending therebetween, the gap rear section tapering 104 in a direction leading towards the gap middle section 108. Typically, the gap front section 106 also tapers in a direction leading towards the gap middle section 108. This structure is achieved with cap screwing belt deforming elements 110 provided each longitudinally between respective pairs of pulleys 98 and 100, and which push the cap screwing belts 28 towards each other in the gap middle section 108, past the outer diameters of the pulleys 98 and 100. Typically, the gap middle section 108 is of substantially constant width therealong due to a suitably shaped cap screwing belt deforming elements 110. The cap screwing belt deforming elements 110 may be fixed relative to the pulleys 98 and 100, or laterally movable relative thereto to deform more or less the cap screwing belts 28 relative to the pulleys 98 and 100.

For example, each cap screwing belt deforming elements 110 includes a deforming element belt 117 supported in a generally triangular configuration by three guiding element pulleys or gears 113, which a freely rotatable. The deforming element belt 117 abuts against the cap screwing element belt 28 along one side of the triangle formed by the deforming element belt 117, from inside the loop formed by the cap screwing element belt 28. Another example of cap screwing belts usable with the present invention and their operation is described in U.S. Pat. No. 7,325,369 to Jalbert issued Feb. 5, 2008, the contents of which is hereby incorporated by reference in its entirety.

Referring to FIG. 3, there is shown the cap receiving element 22. The cap receiving element 22 receives the threaded cap 12 from the cap distributor 18, seen in FIG. 1 and guides the threaded cap 12 to a cap delivery position as shown in FIG. 3. In the cap delivery position, the threaded cap 12 is positioned to engage the threaded finish 16 so that the threaded container 14 entrains the threaded cap 12. To that effect, the threaded cap is presented at a suitable distance above the conveyor bottom belt 36 (not shown in FIG. 3), and slightly inclined relative thereto, so that the threaded container 14 clears the back of the threaded cap 12 while abutting against the front of the threaded cap 12.

More specifically, the cap receiving element 22 defines a cap receiving element passageway 40 therealong that terminates in a cap receiving element passageway outlet 42. A stopper 44 may be provided substantially adjacent to the cap receiving element passageway outlet 42. The stopper 44 takes for example the form of a pair of stopping rods 46 each defining a respective stopping rod free end 48 and each supported by a respective stopping rod support 51 extending longitudinally from the remainder of the cap receiving element 22. The stopping rods 46 are laterally slightly spaced apart from the cap receiving element passageway outlet 42 and the stopping rod free ends 48 are spaced apart by a distance that is substantially similar to, but slightly smaller than, the diameter of the threaded cap 12. Thus, the threaded cap 12 is stopped by the stopper 44 when exiting the cap receiving element passageway outlet 42. The distance between the stopping rod free ends 48 is selected so that the stopper 44 prevents the threaded cap 12 from exiting completely the cap receiving element passageway 40 while allowing the threaded container 14 to entrain the threaded cap 12. In some embodiments, the stopping rod free ends 48 are covered in rubber, a foam or in any other suitable resiliently deformable material to allow such passage of the threaded cap 12.

The cap receiving element passageway 40 is typically substantially rectilinear and has a height and width substantially similar to those of the threaded cap 12, albeit slightly larger, to allow the latter to move relatively freely therealong while preserving its attitude relative to the remainder of the capping machine 10. The cap receiving element passageway 40 is also typically slightly sloped relative to the conveyor bottom belt 36, with the cap receiving element passageway outlet 42 at its lower end, to present the threaded cap 12 at a corresponding angle.

Figure 4:
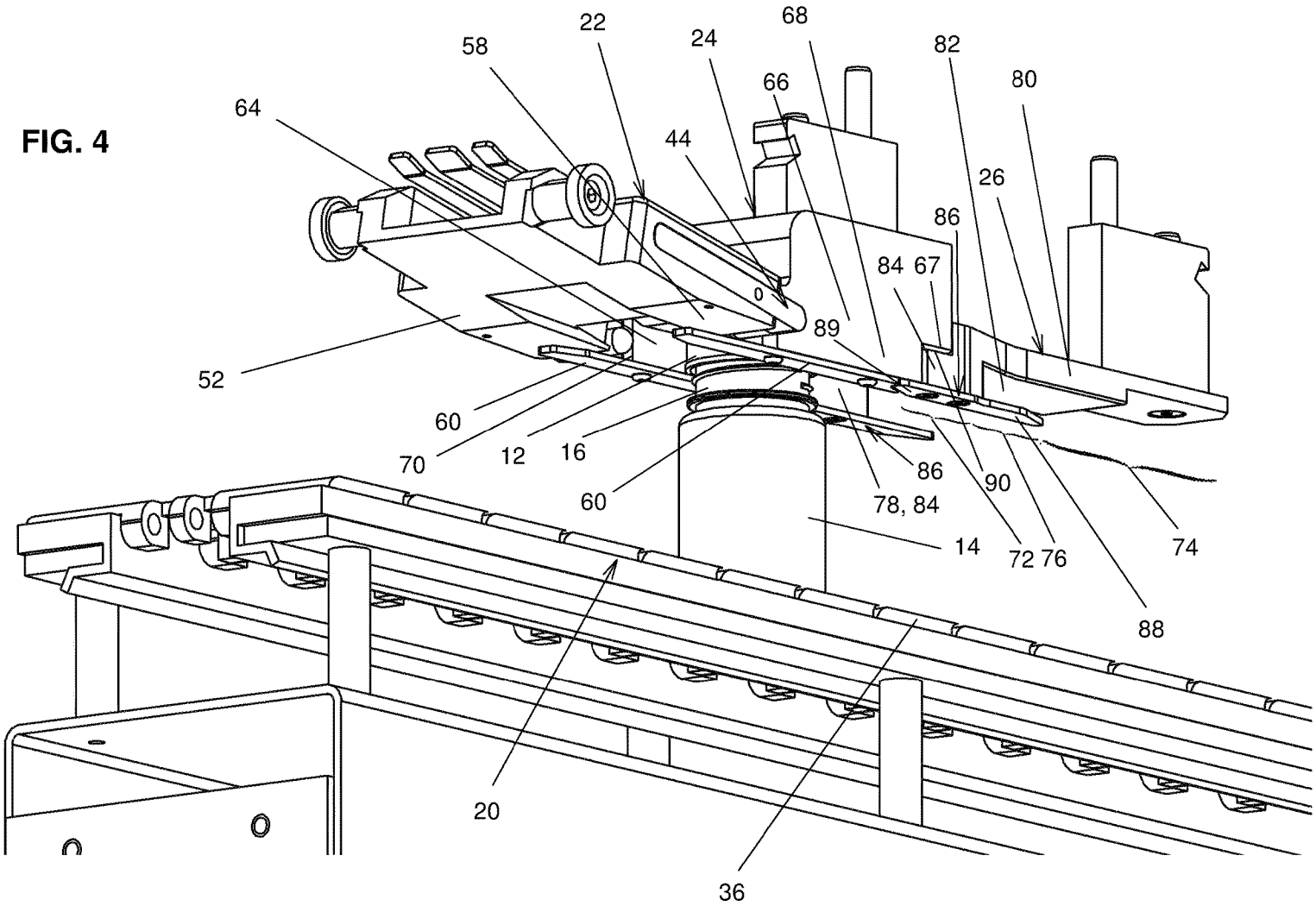
FIG. 4, in a perspective view with parts removed, illustrates a second step in the operation of the capping machine of FIG. 1.
Figure 5:
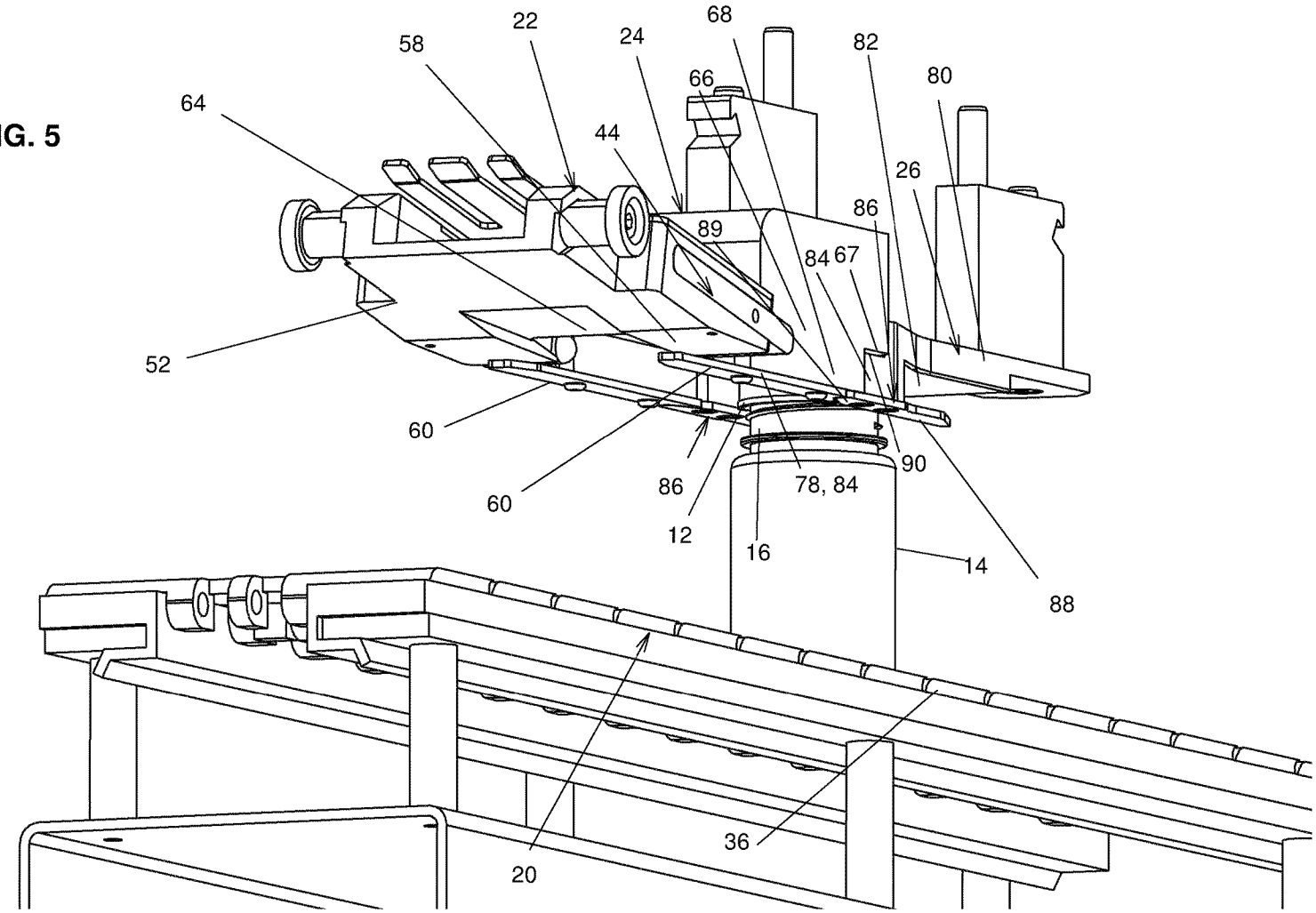
FIG. 5, in a perspective view with parts removed, illustrates a third step in the operation of the capping machine of FIG. 1.
Figure 6:
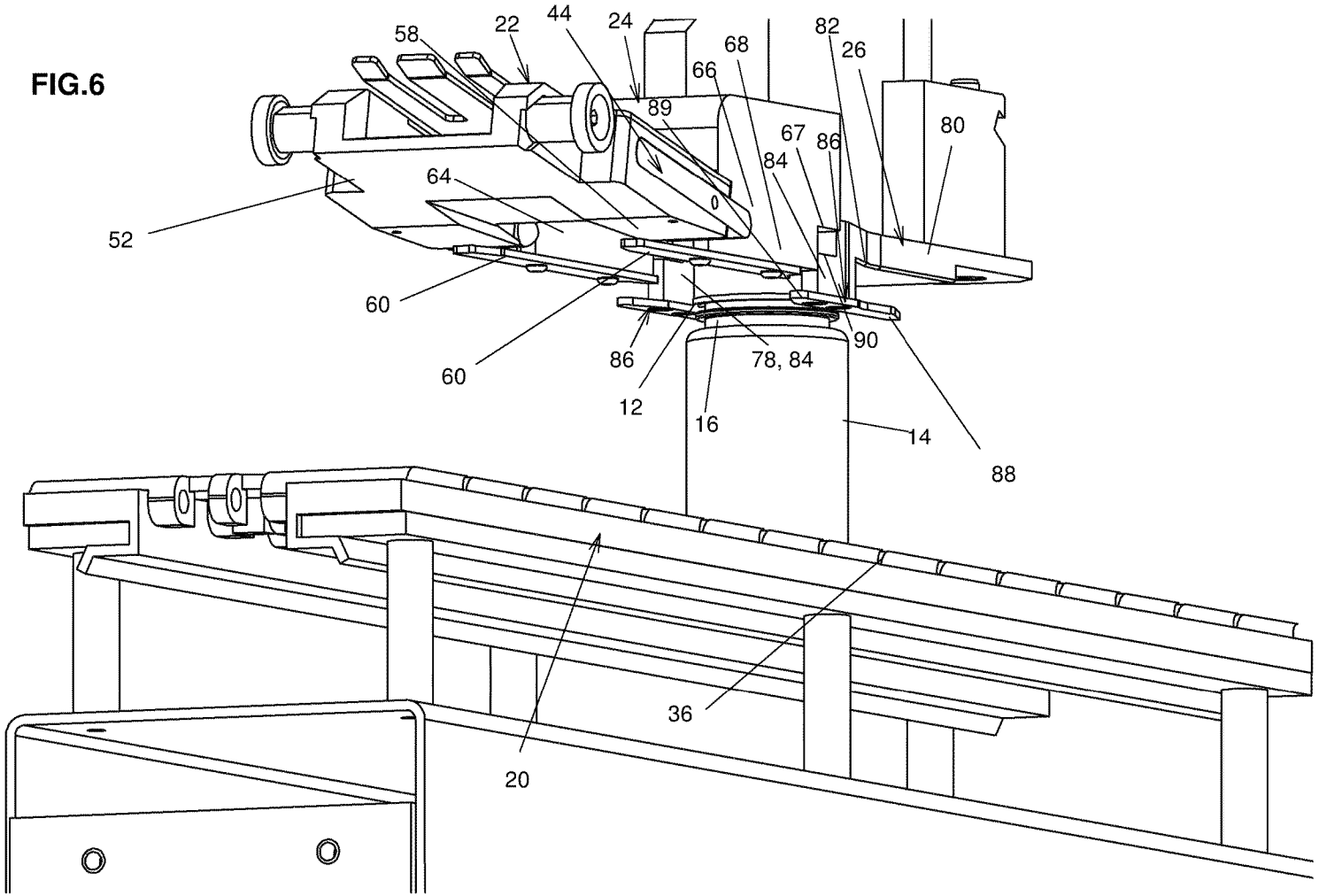
FIG. 6, in a perspective view with parts removed, illustrates a fourth step in the operation of the capping machine of FIG. 1.

The cap receiving element 22 defines substantially opposed cap receiving element top and bottom surfaces 50 and 52, with the cap receiving element passageway 40 provided therebetween. In some embodiments, the cap receiving element top surface 50 is provided with a cap receiving element protrusion 54 that protrudes forwardly therefrom and abuts on a cap stabilizing element ledge 56 described in further details hereinbelow. As seen in FIG. 4, the cap receiving element bottom surface 52 has a cap receiving element bottom surface front portion 58 that is substantially horizontal and which is supported by cap stabilizing element flanges 60, also described in further details hereinbelow. The cap receiving element protrusion 54 and cap receiving element bottom surface front portion 58 ensure that the cap receiving element 22 remains at a suitable position relative to the cap stabilizing element 24 to allow continuous passage of the threaded cap 12 from the cap receiving element 22 to the cap stabilizing element 24. The cap receiving element 22 is supported to the remainder of the capping machine 10 at the rear thereof by a pair of laterally extending cap receiving element supports 62.

The cap stabilizing element 24 is shown for example in FIG. 4. Typically, the cap stabilizing element 24 remains fixed relative to the cap receiving element 22 while the threaded cap 12 is advanced therealong. The cap stabilizing element 24 is provided to stabilize the threaded cap 12 in a suitable attitude prior to being screwed, typically substantially perpendicular to the longitudinal axis of the threaded container 14. In some embodiments, the cap stabilizing element 24 is omitted and the threaded cap 12 enters directly the cap guiding element 26 when exiting the cap receiving element 22. The cap guiding element 26 may then be slightly longer. The cap stabilizing element 24 is provided at a distance above the conveyor bottom belt 36 such that the threaded cap 12 engages the threaded finish 16 without requiring any engagement of the threads thereof.

The cap stabilizing element 24 defines a cap stabilizing element recess 64 extending therealong for substantially fittingly receiving the threaded cap 12 thereinto as the threaded cap 12 is advanced therealong. As better seen in FIG. 8, the cap stabilizing element recess 64 starts substantially adjacent the stopper 44 and is substantially rectilinear. The cap stabilizing element recess 64 has a height and width substantially similar to those of the threaded cap 12, albeit very slightly larger, to allow the latter to move relatively freely therealong while preserving its attitude relative to the remainder of the capping machine 10. For example, and non-limitingly, the height of the cap stabilizing element recess 64 is between about 0.7 and about 0.9 mm more than the height of the threaded cap 12.

Figure 8:
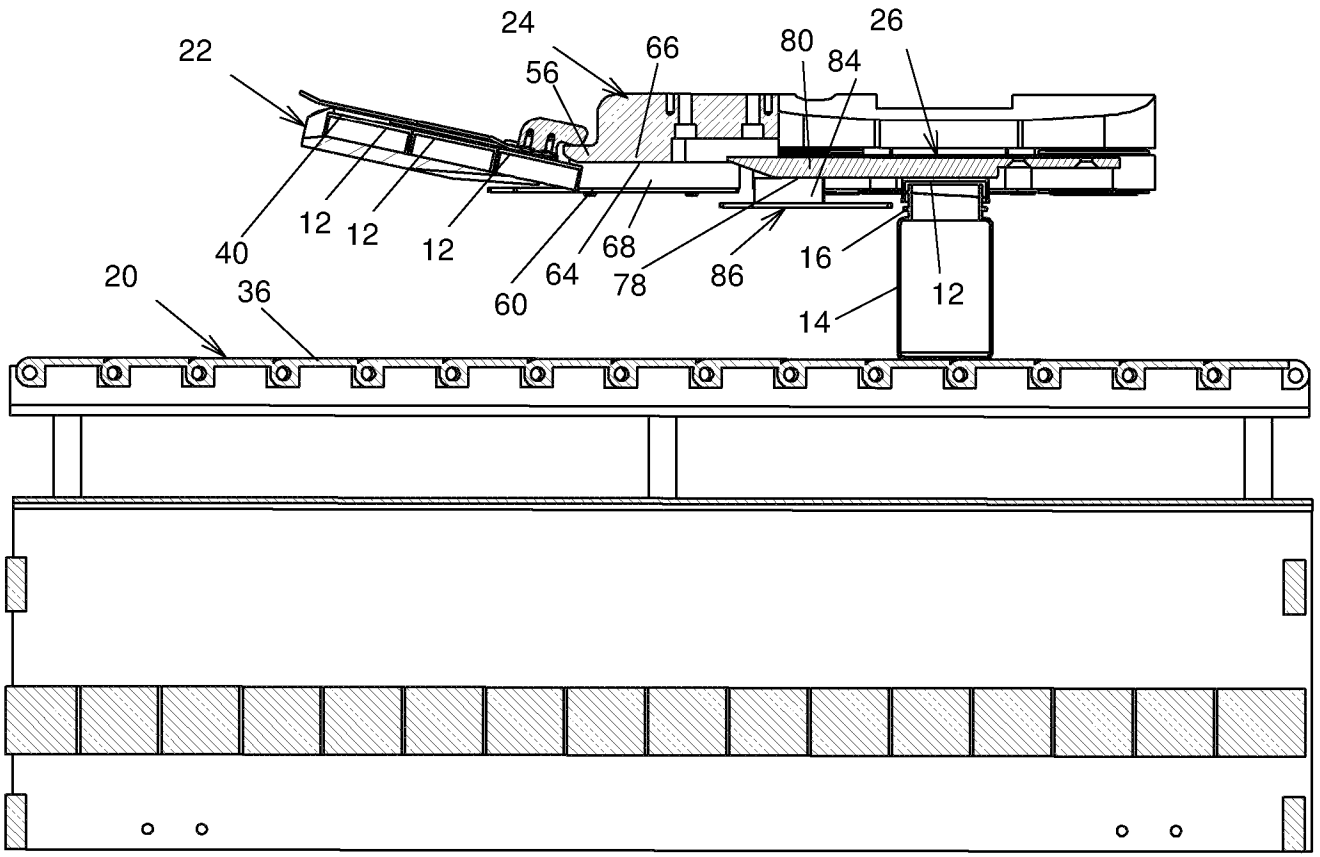
FIG. 8, in a side cross-sectional view, illustrates a cap receiving element, a cap stabilizing element and a cap guiding element part of the capping machine of FIG. 1.

More specifically, the cap stabilizing element recess 64 is defined by a cap stabilizing element upper wall 66, a pair of laterally opposed and spaced apart cap stabilizing element side walls 68 extending downwardly from the cap stabilizing element 24 upper wall, only one of which is shown in FIG. 8, and a pair of cap stabilizing element flanges 60 protruding laterally inwardly each from a respective one of the cap stabilizing element side walls 68, opposed to the cap stabilizing element upper wall 66. In some embodiments, the cap stabilizing element flanges 60 do not reach the front of the cap stabilizing element side walls 68 for reasons mentioned hereinbelow.

The cap stabilizing element flanges 60 are spaced apart by a distance allowing passage of the threaded finish 16 therebetween, while supporting the threaded cap 12 thereonto. As better seen in FIG. 4, in come embodiments, the cap stabilizing element flanges 60 protrude readwardly from the cap stabilizing element side walls 68.

The cap stabilizing element upper wall 66 defines the cap stabilizing element ledge 56. Also, the cap stabilizing element upper wall 66 may define a cap stabilizing recess inlet 70 that is substantially taller than the remainder of the cap stabilizing element recess 64 to allow entrance of the slightly inclined threaded cap 12 thereinto. Furthermore, in some embodiments, the cap stabilizing element upper wall 66 defines a generally downwardly facing cap stabilizing element upper wall abutment surface 67 at the front thereof.

The cap guiding element 26 is shown for example in FIG. 4. The cap guiding element 26 moves relative to the cap stabilizing element 24 while the threaded cap 12 is advanced therealong. The cap guiding element 26 is provided to stabilize the threaded cap 12 in a suitable attitude while the latter is screwed, typically substantially perpendicular to the longitudinal axis of the threaded container 14. To that effect, the cap guiding element 26 guides the threaded cap 12 during the screwing process.

In opposition to commonly used capping machines for which the cap is only guided by pressing thereonto, the cap guiding element 26 gives only two degrees of freedom to the threaded cap 12 until the threaded cap 12 has been at least partially screwed on the threaded finish 16: advancing along the cap guiding element 26, along with the threaded container 14, and rotating about a vertical axis to be screwed on the threaded finish 16. Other degrees of freedom, that is tilt about horizontal axes and up/down or lateral movements are prevented during this initial phase of screwing the threaded cap 12. This essentially prevents cross-threading.

The cap guiding element 26 includes a cap guiding element rear portion 72, a longitudinally opposed cap guiding element front portion 74 and a cap guiding element middle portion 76 extending therefrom. The restriction in degrees of freedom discussed in the preceding paragraph is found in the cap guiding element rear portion 72. In the cap guiding element middle portion 76, lateral movements are prevented by the cap screwing belts 28, but downward movements are prevented by a suitable structure. Finally, the cap guiding element front portion 74 does not require any element to prevent downward movements of the threaded cap 12 as the threaded cap 12 is engaged to the threaded finish 16 and at least partially screwed thereon when the threaded cap 12 reaches the cap guiding element front portion 74. However, in some embodiments, the cap guiding element front portion 74 also prevents downward movements of the threaded cap 12.

The cap guiding element 26 defines a cap guiding element recess 78 extending along part thereof for substantially fittingly receiving the threaded cap 12 thereinto as the threaded cap 12 is advanced therealong. Typically the cap guiding element recess 78 extends from the back of the cap guiding element 26 and along the whole cap guiding element front portion 74.

More specifically, the cap guiding element 26 defines the cap guiding element upper wall 80, which typically defines a substantially flat cap guiding surface 82. In some embodiments, the cap guiding surface extends along only part of the cap guiding element upper wall, with the front of the cap guiding element upper wall 80 being upwardly recessed relative to the cap guiding surface 82 so that when two successive threaded containers 14 are close to each other, the threaded cap 12 on the first one does not contact the cap guiding element upper wall 80 when the threaded cap 12 on the second one is being screwed. The cap guiding element 26 also defines a pair of laterally opposed and spaced apart cap guiding element side walls 84 extending downwardly from the cap guiding element upper wall 80 and extending longitudinally along part thereof, and a pair of cap guiding element flanges 86 protruding laterally inwardly each from a respective one of the cap guiding element side walls 84 opposed to the cap guiding element upper wall 80. The cap guiding element side walls 84 extend along the cap guiding element rear portion 72.

The cap guiding element flanges 86 are laterally spaced apart from each other by a distance sufficient to allow insertion of the threaded finish therebetween, but small enough that the threaded cap 12 is supported thereonto. Each cap guiding flange 86 defines a forward protruding portion 88 protruding forwardly from the cap guiding element side walls 84. The forward protruding portions 88 extend along the cap guiding element middle portion 76. Typically, the cap screwing belts 28 have at least part thereof in register with the forward protruding portions 88. In some embodiments, when the cap stabilizing element flanges 60 do not reach the front of the cap stabilizing element side walls 68, the cap guiding element flanges 86 also each define a backward protruding portion 89 that terminate substantially adjacent the cap stabilizing element flanges 60.

In some embodiments, the cap guiding element upper wall 80 defines a generally upwardly facing cap guiding element upper wall abutment surface 90 at the rear thereof. The cap guiding element upper wall recess 90 abuts against cap the stabilizing element upper wall abutment surface 67 when the cap guiding element 26 is in the upper position to prevent inadvertent movements of capping machine guiding element 26 past the upper position.

Referring to FIG. 8, the cap receiving element passageway 40, cap stabilizing element recess 64 and the cap guiding element recess 78 form a structure that controls the attitude, lateral position and height above the conveyor 20 of the threaded cap 12 as the latter is pickup by the threaded container 14 and advanced towards the cap screwing belts 28 (not seen in FIG. 8). When the latter are reached, they engage the threaded cap 12 therebetween to screw the threaded cap 12. The reader skilled in the art will appreciate that the cap receiving element passageway 40, cap stabilizing element recess 64 and the cap guiding element recess 78 could be structured in any suitable manner controlling the attitude of the threaded cap 12 as described hereinabove. For example, and non-limitingly, the cap stabilizing and guiding element upper walls 66 and 80 could be replaced by pair of opposed flanges against which the threaded cap 12 abuts.

While not essential in all embodiments, the interface at the junction of the cap stabilizing and guiding elements 24 and 26 described hereinabove minimizes disturbances on the threaded cap 12 as the threaded cap transitions therebetween to reduce the possibility of cross-threading. Indeed, the discontinuity of structures located below, laterally and above relative to the threaded cap 12 are longitudinally spaced apart from each other. The discontinuity between the cap stabilizing element flanges 60 and the cap guiding element flanges 86 is behind the discontinuity between the cap stabilizing element side walls 68 and the cap guiding element side walls 84, which is behind the discontinuity between the cap stabilizing element upper wall 66 and the cap guiding element upper wall 80.

The reader skilled in the art will understand that the cap receiving, stabilizing and guiding elements 22, 24 and 26 could be shaped differently from the shape they have as long as they guide the threaded cap 12 as described hereinabove.

The cap guiding element 26 moves from the upper position to the lower position as the threaded cap 12 is screwed. For proper operation, the capping machine 10 requires that this movement be synchronized with the presence of the threaded cap 12 in register with the cap guiding element 26. This synchronization is performed through the interaction of the sensor 30, controller 32 and cap guiding element actuator 34.

Referring to FIG. 9, the cap stabilizing element 24 is mounted to a cap stabilizing element mount 111 that is itself mounted to the remainder of the capping machine 10 (not shown in FIG. 9). The cap stabilizing element mount 111 may be stationary relative to the conveyor 20. However, is advantageous to have the cap stabilizing element mount 111 movable up and down relative to the conveyor 20 when the capping machine 10 is setup to accommodate threaded containers 14 having various dimensions. In other embodiments, it is the conveyor 20 that may be moved relative to the remainder of the capping machine 10. Such adjustments are made in a conventional manner.

The cap guiding element 26 is mounted to a cap guiding element mount 112. Since it is advantageous to control precisely the position of the cap guiding element 26, in some embodiments, the cap guiding element mount 112 is linked to the cap stabilizing element mount 111 as described hereinbelow. However, in alternative embodiments, the cap guiding element mount 112 is simply mounted to the remainder of the capping machine 10 so as to be movable relative thereto in any suitable manner.

A pair of substantially parallel linking arms 114 are each mounted at respective ends thereof to the cap stabilizing element mount 111 and to the cap guiding element mount 112. The linking arms 114 are vertically spaced apart from each other. For example, the linking arms 114 are substantially parallel to the conveyor 20 when the cap guiding element 26 is in the upper position, as seen in FIG. 9. Lowering of the cap guiding element 26 to the lower position is achieved by lowering the cap guiding element mount 112, which causes the linking arms to pivot slightly relative to the cap stabilizing element mount 111 and cap guiding element mount 112. This pivotal movement of the linking arms 114 is typically relatively small as the length of the linking arms 114 is typically much larger than the distance covered by the cap guiding element 26 as the latter is moved between the upper and lower positions. This small pivotal movement results in correspondingly small horizontal movements of the cap guiding element 26, which can be accommodated by having a small gap between the cap guiding element 26 and cap stabilizing element 24, or by having surfaces of the cap guiding element 26 and cap stabilizing element 24 that are adjacent to each other suitably shaped to allow such movements.

The cap guiding element actuator 34 extends between the cap guiding element mount 112 and the remainder of the capping machine 10, and is typically secured to a substantially rigid frame (not shown in the drawings). The cap guiding element actuator 34 is any actuator that may move the cap guiding element mount 112 so that the cap guiding element 26 is moved between the upper and lower positions. Thus the cap guiding element actuator may include a linear motor, a pneumatic cylinder, a belt mounted between two pulleys, among other possibilities.

FIG. 9 illustrates the case in which the cap guiding element actuator 34 includes a conventional pneumatic cylinder 116 having a sleeve 118 and a piston 120 movable relative to each other by injecting a pressurized gas into one of two ports 122 and 124, to cause respective movements of extension and retraction of the piston 120 relative to the sleeve 118. One of the sleeve 118 and piston 120, the sleeve 118 in FIG. 9, is coupled to the cap guiding element mount 112, and the other one, the piston 120 in FIG. 9, is coupled to the frame of the capping machine 10 (not shown in FIG.

9). A conventional pneumatic actuator 126, including a pump and pressurized gas reservoir extends between the two ports 122 and 124 and is used to provide the pressurized gas in a conventional manner.

It should be noted that the capping machine 10 may be operated so that any movement of the piston 120, ie retraction and extension, is performed by forcefully injecting pressurized gas in one of the ports 122 and 124. However, it is also possible in some embodiments to allow one of these two movements to happen passively, by simply allowing passive gas flow between the ports 122 and 124, and relying on other forces to cause corresponding movement of the cap guiding element 26. These other forces may be simply the gravitational attraction on the combined mass of the cap guiding element 26 and cap guiding element mount 112. In this case, it is a lowering movement that is passive. In another example, a biasing element, such as a spring, biases the cap guiding element mount 112 either downwardly or upwardly, which therefore allows passive movement of the cap guiding element mount 112 in the corresponding direction.

Thus, in some embodiments, the cap guiding element actuator 34 actively moves the cap guiding element 26 downwardly from the upper position to the lower position at a controlled predetermined rate when the threaded cap 12 is screwed. This rate is typically constant along this whole movement. In other embodiments, the cap guiding element actuator 34 moves passively downwardly when the threaded cap 12 is screwed.

The cap guiding element actuator 34 is controlled by the controller 32. The controller 32 is any device that can synchronize the movements of the cap guiding element actuator 34 with the passage of the threaded cap 12 and control the cap guiding element actuator 34 to allow the cap guiding element 26 to follow the threaded cap 12 as the latter is screwed. The controller 32 may be mechanical or an electronic controller that may include passive electronic components and transistors. However, the controller 32 is often in the form of a conventional general purpose computer running a computer program and including a suitable interface operatively connected to the cap guiding element actuator 34 to issue control signals to the cap guiding element actuator 34 instructing the latter to cause upward or downward movements of the cap guiding element 26, as described hereinabove, either actively or passively. The interface, and thus the controller 32 is also adapted to receive sensor signals from the sensor 30 to synchronize operation of the capping machine 10 with the passage of the threaded caps and containers 12 and 14 therealong.

More specifically, the sensor 30, seen in FIG. 10, is positioned to sense a specific event in the advancement of the threaded caps and containers 12 and 14 along the capping machine 10. Typically, threaded caps and containers 12 and 14 are provided serially to the capping machine 10, one after the other. The specific event may be the pickup of a threaded cap 12 by the threaded container 14 as the latter advances past the pickup location. This is the case with the sensor 30 shown in FIG. 10. However, the specific event may also be a direct detection that the threaded cap 12 has completely entered the cap guiding element 26, among other possibilities.

Detection of the specific event may be performed in any suitable manner, for example optically, through ultrasound or using mechanical switches, among other possibilities. Optical and ultrasound detection may involve detection of a reflection of respectively light or sound waves on the threaded cap 12 or threaded container 14. Optical and ultrasound detection may also involve detection of the interruption of a respectively light or sound waves by the threaded cap 12 or threaded container 14. Such detection causes the sensor 30 to issue a sensor signal to the controller 32. The sensor signal is typically an electrical signal that signals that the specific event occurred. The electrical signal may for example by a pulse of raised or lowered voltage. Such control signals are well known in the art and not described in further details herein.

FIG. 10 illustrates the specific case of an optical sensor 30 in which light emitted for example by an LED, is used to illuminate the threaded cap 12 at the pickup location. A light detector, for example a photoresistor, measures the light reflected by the threaded cap. When the threaded cap 12 is picked up, and the sensor 30 is suitably positioned, there is a brief moment before the next threaded cap 12 arrives at the pickup location during which the amount of reflected light changes significantly. This chance causes the sensor signal to be conveyed to the controller 32.

In this specific example, the event of interest is complete entry of the threaded cap 12 in the cap guiding element 26. However, the event that is detected is simply pickup of the threaded cap 12 at the pickup location. Timing of lowering of the cap guiding element 26 is achieved by inserting a delay between detection of the pickup of the threaded cap 12 and start of the lowering movement. This delay is predetermined as the speed at which the conveyor 20 advances, and thus the speed at which the threaded cap and container 12 and 14 advance, are known. This delay may be controlled by the controller 32. However, in other embodiments, the delay is controlled by the sensor 30, which correspondingly delays issuance of the sensor signal. Thus, the sensor 30 is positioned and operative for indicating when the threaded cap 12 has advanced in register with the cap guiding element 26 and issuing a corresponding sensor 30 signal. Issuance of the sensor signal may indicate directly that the threaded cap 12 is in register with the cap guiding element 26, or that the threaded cap 12 will be in register with the cap guiding element 26 at a predetermined time in the future.

The controller 32 is also typically operative to for activating the cap guiding element actuator 34 to move back the cap guiding element 26 to the upper position once the threaded cap 12 has advanced past the cap guiding element 26. This prepares the capping machine 10 for the next screwing process. Such movement back to the upper position may be based on a predetermined delay after start of the lowering process, or caused by reception of a suitable signal from another sensor located at a position where the threaded container 14 with the threaded cap 12 screwed thereon passes after completion of the screwing process. Since the specific details of how this synchronization of the raising process are similar to those of the lowering process, they are not described in further details herein.

The capping machine 10 thus implements a capping method as follows. While the method is performed, the threaded container 14 is advanced forwardly along a predetermined path by the conveyor 20. Typically, the conveyor 20 operates at a constant speed, but variable speed, stop and go and even some backward motions are possible in some embodiments of the invention.

The cap receiving element 22 receives the threaded caps 12 from the cap distributor 18 and presents one to the threaded container 14 at a cap pickup location along the predetermined path. When the conveyor 20 has advanced the threaded container 14 adjacent to the pickup location, the threaded cap 12 is engaged with the threaded container 14 at the pickup location. Subsequently, the threaded container 14 entrains the threaded cap 12 therewith.

After pickup, the method includes fixing the attitude of the threaded cap 12 to a predetermined attitude forwardly of the pickup location. This action is performed by the cap stabilizing element 24 as described hereinabove. Then, the threaded cap 12 advances between the cap screwing belts 28, which screw the threaded cap 12 on the threaded container 14 while the threaded container 14 and threaded cap 12 advance along the predetermined path.

The method includes forcing the threaded cap 12 to maintain the predetermined attitude until the threaded cap 12 is at least partially screwed on the threaded container 14. This action is performed by the cap guiding element 26, which is lowered towards the threaded container as the threaded cap 12 is screwed. After the threaded cap 12 has been sufficiently screwed that cross-threading becomes impossible, holding the threaded cap 12 in the predetermined attitude is not longer necessary, but may still be performed in some embodiments.

Although the present invention has been described hereinabove by way of preferred embodiments thereof, it can be modified, without departing from the spirit and nature of the subject invention as defined in the appended claims.

What is claimed is:

1. A capping machine for screwing a threaded cap on a threaded container having a threaded finish, the capping machine receiving the threaded cap from a cap distributor, the capping machine comprising:

a conveyor for moving forwardly the threaded container in a longitudinal path along the capping machine;

a cap receiving element provided above the conveyor for receiving the threaded cap from the cap distributor and presenting the threaded cap to the threaded container, the cap receiving element being configured and positioned so that the threaded container engages and entrains the threaded cap when the threaded container advances past the threaded cap;

a pair of laterally opposed cap screwing belts provided forwardly relative to the cap receiving element, the cap screwing belts being closed loop belts rotatable at different speeds and defining a cap receiving gap therebetween, the cap receiving gap being configured and sized to allow the cap screwing belts to rotate the threaded cap when the threaded cap is in the cap receiving gap;

wherein each cap screwing belt includes, on a side facing the longitudinal path:

a front section, a middle section and a rear section, the middle section being closer to the longitudinal path than the front section and the rear section, the front section tapering toward the middle section when moving in a forward conveyance direction of the longitudinal path and the rear section tapering away from the middle section when moving in the forward conveyance direction, wherein the middle section is positioned closer to the longitudinal path by a deforming element belt that is positioned within a loop defined by the cap screwing belt, the deforming element belt being a closed loop belt that abuts an internal side of the cap screwing belt;

a cap guiding element defining an upper cap guide provided at least in part above the cap screwing belts for abutting downwardly on the threaded cap as the threaded cap is moved, the cap guiding element being movable between an upper position and a lower position corresponding respectively to an unscrewed threaded cap and to an at least partially screwed threaded cap, the upper cap guide being configured for abutting downwardly against the threaded cap when the threaded cap is in register therewith;

a cap guiding element actuator operatively coupled to the cap guiding element for actively moving the cap guiding element between the upper and lower positions;

a sensor positioned and operative for indicating when the threaded cap has advanced in register with the cap guiding element and issuing a corresponding sensor signal; and a controller operatively coupled to the cap guiding element actuator to selectively activate the cap guiding element actuator to actively move the cap guiding element between the upper and lower positions, the controller being operatively coupled to the sensor for receiving the sensor signal with the cap guiding element in the upper position and consequently causing the cap guiding element to actively move towards the lower position at a controlled predetermined rate as the cap screwing belts screw the threaded cap on the threaded container;

wherein the cap guiding element is configured and sized to constrain the threaded cap in a fixed attitude relative to the capping machine when the threaded cap is advanced along at least part of the cap guiding element, wherein said fixed attitude is substantially perpendicular to a longitudinal axis of the threaded container.

2. The capping machine as defined in claim 1, wherein the controller is further operative for activating the cap guiding element actuator to move back the cap guiding element to the upper position once the threaded cap has advanced past the cap guiding element.

3. The capping machine as defined in claim 1, wherein the cap guiding element actuator is a pneumatic actuator.

4. The capping machine as defined in claim 1, further comprising a cap stabilizing element provided between the cap receiving element and the cap guiding element for stabilizing an attitude of the threaded cap before the threaded cap reaches the cap guiding element.

5. The capping machine as defined in claim 4 wherein the cap stabilizing element remains fixed relative to the cap receiving element while the threaded cap is advanced therealong.

6. The capping machine as defined in claim 5, wherein the cap stabilizing element defines a cap stabilizing element recess extending therealong for substantially fittingly receiving the threaded cap thereinto as the threaded cap is advanced therealong.

7. The capping machine as defined in claim 6, wherein the cap stabilizing element defines a cap stabilizing element upper wall, a pair of laterally opposed and spaced apart cap stabilizing element side walls extending downwardly from the cap stabilizing element upper wall, and a pair of cap stabilizing element flanges protruding laterally inwardly each from a respective one of the cap stabilizing element side walls opposed to the cap stabilizing element upper wall.

8. The capping machine as defined in claim 1, wherein the cap guiding element defines a cap guiding element recess extending along part thereof for substantially fittingly receiving the threaded cap thereinto as the threaded cap is advanced therealong.

9. The capping machine as defined in claim 8, wherein the cap guiding element recess extends from the back of the cap guiding element.

10. The capping machine as defined in claim 1, wherein the cap guiding element defines a cap guiding element upper wall, a pair of laterally opposed and spaced apart cap guiding element side walls extending downwardly from the cap guiding element upper wall and extending longitudinally along part thereof, and a pair of cap guiding element flanges protruding laterally inwardly each from a respective one of the cap guiding element side walls opposed to the cap guiding element upper wall.

11. The capping machine as defined in claim 10, wherein the cap guiding element flanges each define a forward protruding portion protruding forwardly from the cap guiding element side walls.

12. The capping machine as defined in claim 11, wherein the cap screwing belts have part thereof in register with the forward protruding portions.

13. The capping machine as defined in claim 1, further comprising a chute for receiving a plurality of said caps serially and delivering said caps to said cap receiving element.

14. The capping machine as defined in claim 1, wherein the conveyor includes a bottom belt for resting the threaded containers thereonto and a pair of side belts between the bottom belt and the cap screwing belts for gripping the threaded container therebetween.

15. The capping machine as defined in claim 1, wherein the conveyor advances the threaded container at a substantially constant speed therealong.

16. A capping machine for screwing a threaded cap on a threaded container having a threaded finish, the capping machine receiving the threaded cap from a cap distributor, the capping machine comprising:

a conveyor for moving forwardly the threaded container in a longitudinal path along the capping machine;

a cap receiving element provided in register with and spaced apart from the conveyor for receiving the threaded cap from the cap distributor and presenting the threaded cap to the threaded container, the cap receiving element being configured and positioned so that the threaded container engages and entrains the threaded cap when the threaded container advances past the threaded cap;

a pair of laterally opposed cap screwing belts provided forwardly relative to the cap receiving element, the cap screwing belts being closed loop belts rotatable at different speeds and defining a cap receiving gap therebetween, the cap receiving gap being configured and sized to allow the cap screwing belts to rotate the threaded cap when the threaded cap is in the cap receiving gap;

a cap guiding element defining an upper cap guide, the cap screwing belts being provided between the upper cap guide and the conveyor, the cap guiding element being movable between an upper position and a lower position corresponding respectively to an unscrewed threaded cap and to an at least partially screwed threaded cap, the cap guiding element being configured for abutting against the threaded cap towards the conveyor when the threaded cap is in register therewith;

a cap guiding element actuator operatively coupled to the cap guiding element for actively moving the cap guiding element between the upper and lower positions;

a sensor positioned and operative for indicating when the threaded cap has advanced in register with the cap guiding element and issuing a corresponding sensor signal; and a controller operatively coupled to the cap guiding element actuator to selectively activate the cap guiding element actuator to actively move the cap guiding element between the upper and lower positions, the controller being operatively coupled to the sensor for receiving the sensor signal with the cap guiding element in the upper position and consequently causing the cap guiding element to actively move towards the lower position at controlled rate as the cap screwing belts screw the threaded cap on the threaded container;

wherein the cap guiding element is configured and sized to constrain the threaded cap in a fixed attitude relative to the capping machine when the threaded cap is advanced along at least part of the cap guiding element, wherein said fixed attitude is substantially perpendicular to a longitudinal axis of the threaded container so as to prevent cross-threading.

17. A capping machine for screwing a threaded cap on a threaded container having a threaded finish, the capping machine receiving the threaded cap from a cap distributor, the capping machine comprising:

a conveyor for moving the threaded container in a longitudinal path in a forward direction;

a cap receiving element for receiving the threaded cap from the cap distributor and presenting the threaded cap onto the threaded container as the threaded container advances along the conveyor;

a pair of laterally opposed cap screwing belts provided, the cap screwing belts being closed loop belts rotatable at different speeds and defining a cap receiving gap therebetween such that the cap screwing belts will engage and rotate the threaded cap when the threaded cap is in the cap receiving gap, wherein each cap screwing belt includes a deforming element belt that is positioned within a loop defined by the cap screwing belt, the deforming element belt being a closed loop belt that abuts an internal side of the cap screwing belt;

a cap guiding element defining an upper cap guide provided at least in part above the cap screwing belts for abutting downwardly on the threaded cap as the threaded cap is moved, the cap guiding element being movable between an upper position and a lower position; and a cap guiding element actuator operatively coupled to the cap guiding element for moving the cap guiding element between the upper position and the lower position.

18. The capping machine of claim 17, further comprising:

a controller operatively coupled to the cap guiding element actuator to selectively activate the cap guiding element actuator to actively move the cap guiding element from the upper position towards the lower position at a controlled predetermined rate as the cap screwing belts screw the threaded cap on the threaded container;

wherein the cap guiding element is configured and sized to constrain the threaded cap in a fixed attitude relative to the capping machine when the threaded cap is advanced along at least part of the cap guiding element.

* * * * *